US008794457B2

(12) United States Patent
Richter

(10) Patent No.: US 8,794,457 B2
(45) Date of Patent: Aug. 5, 2014

(54) GUIDE CABLING ARRANGEMENT FOR A CRANE

(75) Inventor: Yggve Richter, Blaubeuren (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 6 days.

(21) Appl. No.: 13/224,461

(22) Filed: Sep. 2, 2011

(65) Prior Publication Data

US 2012/0061341 A1 Mar. 15, 2012

(30) Foreign Application Priority Data

Sep. 6, 2010 (DE) ..... 20 2010 012 237 U

(51) Int. Cl.
*B66C 13/06* (2006.01)

(52) U.S. Cl.
USPC ..... 212/274; 212/273; 212/256

(58) Field of Classification Search
USPC ..... 212/272–274, 223, 232, 242, 251, 252, 212/255, 259, 271, 167, 256
See application file for complete search history.

(56) References Cited

U.S. PATENT DOCUMENTS

| | | | | |
|---|---|---|---|---|
| 3,638,806 | A * | 2/1972 | Hippach | 212/231 |
| 4,171,053 | A * | 10/1979 | Cecce | 212/274 |
| 5,667,341 | A * | 9/1997 | Kuehn | 405/228 |
| 6,644,486 | B2 * | 11/2003 | Jacoff et al. | 212/274 |
| 7,207,777 | B2 * | 4/2007 | Bervang | 416/119 |
| 2011/0094987 | A1 * | 4/2011 | Botwright et al. | 212/274 |

FOREIGN PATENT DOCUMENTS

| | | |
|---|---|---|
| DE | 60209494 | 8/2006 |
| DE | 202006015189 | 2/2008 |
| DE | 202010003269 | 8/2011 |
| WO | 2008/061797 | 5/2008 |

* cited by examiner

*Primary Examiner* — Emmanuel M Marcelo
*Assistant Examiner* — Angela Caligiuri
(74) *Attorney, Agent, or Firm* — Dilworth & Barrese, LLP.

(57) ABSTRACT

This invention relates to a crane, in particular a telescopic crane, with a frame suspended on the load hook for taking up a special load, in particular for taking up a rotor blade of a wind turbine. In accordance with the invention a single guide cable without guying function is provided, which proceeding from the boom foot is tensioned parallel to the direction of the longitudinal axis of the boom system and is attached to the boom system at its end, wherein a frame suspended on the load hook is connected with the guide cable via at least two control cables.

15 Claims, 2 Drawing Sheets

GUIDE CABLING ARRANGEMENT FOR A CRANE

BACKGROUND OF THE INVENTION

This invention relates to a crane, in particular a telescopic crane, with a frame suspended on the load hook for taking up a special load, in particular for taking up a rotor blade of a wind turbine During the assembly of wind turbines, the rotor blades must be mounted at a great height. For this purpose, truck cranes or crawler cranes preferably are used. The rotor blade to be mounted has a large rotor surface and consequently a large surface exposed to the wind. For mounting the rotor blade at the corresponding wind turbine a sufficiently precise adjustment of the rotor blade taken up is required at the mounting height.

For this purpose it is already known from the prior art to take up the rotor blade by means of a frame. The same is suspended on the load hook of the hoisting cable and takes up the rotor to be mounted in the corresponding receptacle.

In DE 20 2006 015 189 U1 it is proposed for example to attach the rotor blade to the two guy cables of the Y-guy of the main boom via two control cables and secure the same against rotation. A disadvantage of the proposed solution consists in that the guy cables extend far away from the longitudinal axis of the main boom. Consequently, the forces in the horizontally extending control cables considerably influence the guying forces of the Y-guy and reduce the lifting capacity of the crane.

Furthermore, constructions are known in which in the region of the boom foot two additional winches are mounted, whose cables extend in parallel in direction of the boom head. The receptacle for the rotor blade is connected with the tensioned cables via two control cables.

A disadvantage of this known solution on the one hand consists in that the winches and the cables constitute an additional equipment which involves both weight and costs. In addition it is required to tension both cables independent of each other. The tensioning force introduced per cable exerts a load on the boom, since the resultant pressure load behaves like an additional load on the boom. Mounting two independent cables likewise leads to an additional side load of the boom, if one cable is loaded more.

SUMMARY OF THE INVENTION

Proceeding from the explanations set forth above, it is the object of the invention to provide an improved possibility for stabilizing a load taken up.

In accordance with the invention, this object is solved by a crane with the features herein. Accordingly, the crane comprises a frame suitable for taking up a special load, which is suspended on the load hook of the crane. The frame preferably is suitable for taking up a rotor blade for a wind turbine. The subject-matter of the present invention, however, is not limited to taking up a rotor blade. Rather, any load can be taken up by means of the frame. For reasons of simplicity, the subject-matter of the invention will yet be explained below with reference to a frame for taking up a rotor blade.

In accordance with the invention, as compared to the prior art, only one single guide cable without guying function is provided, which is tensioned proceeding from the boom foot parallel to the direction of the longitudinal axis of the boom system and is attached to the boom system at its end. The load in the boom is halved as compared to the prior art, since now only one single guide cable is tensioned. The function of a possibly present guying is not influenced either.

The boom system of the crane according to the invention can consist e.g. of a telescopic boom, a fly jib and possibly a main boom extension.

The frame suspended on the load hook for taking up a special load is connected with the guide cable via at least two control cables and thereby stabilized sufficiently.

Preferred design possibilities of the crane according to the invention are also subject-matter herein.

Independent of the boom system used, the tensioned guide cable can be attached to the boom system at its end depending on the use at variable height. What is preferred is an attachment in sufficient proximity to the pulley head of the boom system, so that a guidance of the at least two control cables used is ensured over the entire hoisting height. At lower hoisting heights it is sufficient to tension the guide cable at its end up to the corresponding region at the boom system.

The control cables are at least partly guided along the guide cable. Guidance expediently is effected by means of guide rollers or the like.

The tension applied to the guide cable advantageously is introduced by means of a winch which preferably is arranged in the region of the boom foot. In the region of the boom foot, an energy supply and a control connection expediently already are provided, with which the winch is coupled to the entire crane bus system or crane control system.

Advantageously, the winch is actuated by the crane controller in a synchronized manner in dependence on a corresponding crane movement. A luffing movement of the fly jib or a telescoping of the corresponding boom part leads to the letting out or winding up of the guide cable by means of the winch under the control of the crane controller. In addition, it is possible to provide the winch with a maximum winding force. Upon exceedance of the limit value, the winch automatically lets out some cable.

Alternatively, the winch also can directly or indirectly be arranged at the articulation piece and/or at the uppercarriage and/or at a luffing cylinder.

In this connection it is found to be expedient when the winch is arranged almost on the line of symmetry of the boom system. The tensioned guide cable hence extends on the plane of symmetry formed in direction of the boom tip up to the point of attachment at the boom system. Due to the arrangement of the winch on the line of symmetry, the side load of the boom caused by the control cables turns out to be considerably smaller as compared to the prior art. The only boom load merely results from the pressure load exerted by the guide cable on the boom system. The guide cable advantageously extends on the plane of symmetry on the boom side facing the load hook.

Advantageously, the control cables extend proceeding from the frame to the guide cable and are deflected by one or more deflection pulleys in the region of the point of connection with the guide cable.

The connection of the control cables with the guide cable advantageously is effected via a connecting link. The connecting link comprises a dual pulley which either directly takes up the control cables or is directly connected with the control cables via deflection pulleys. The connecting link is guided on the guide cable via the dual pulley.

What is advantageous is the arrangement of one or more deflection pulleys on the frame, by which the individual control cables are deflected. In this case, the force in the cable and the cable drive on the frame can be reduced.

Finally, one or more winches can be arranged on the frame, in order to vary the tension of the control cables, so as to maintain a stable position of the frame.

By using the guide cable according to the invention, in contrast to the prior art, the load now can be aligned with a very good angle, even when using a long fly jib. In this connection it should be noted that the main boom tension used in DE 20 2006 015 189 U1 for guiding the control cables only extends behind the main boom and not behind the fly jib. The hoisting height, at which a stabilization of the load taken up is possible by means of the control cables, accordingly is limited to the region of the main boom guy.

By means of the described technical teaching according to the invention it is likewise conceivable to correspondingly retrofit already existing cranes. In this case, an existing crane of any design can be retrofitted by mounting a winch in the region of the boom foot and of the setup of the guide cable parallel to the longitudinal axis of the boom system.

BRIEF DESCRIPTION OF THE DRAWINGS

Further advantages and details of the invention can be taken from an exemplary embodiment illustrated in the drawings, in which.

DESCRIPTION OF THE PREFERRED EMBODIMENTS

Figure 1:
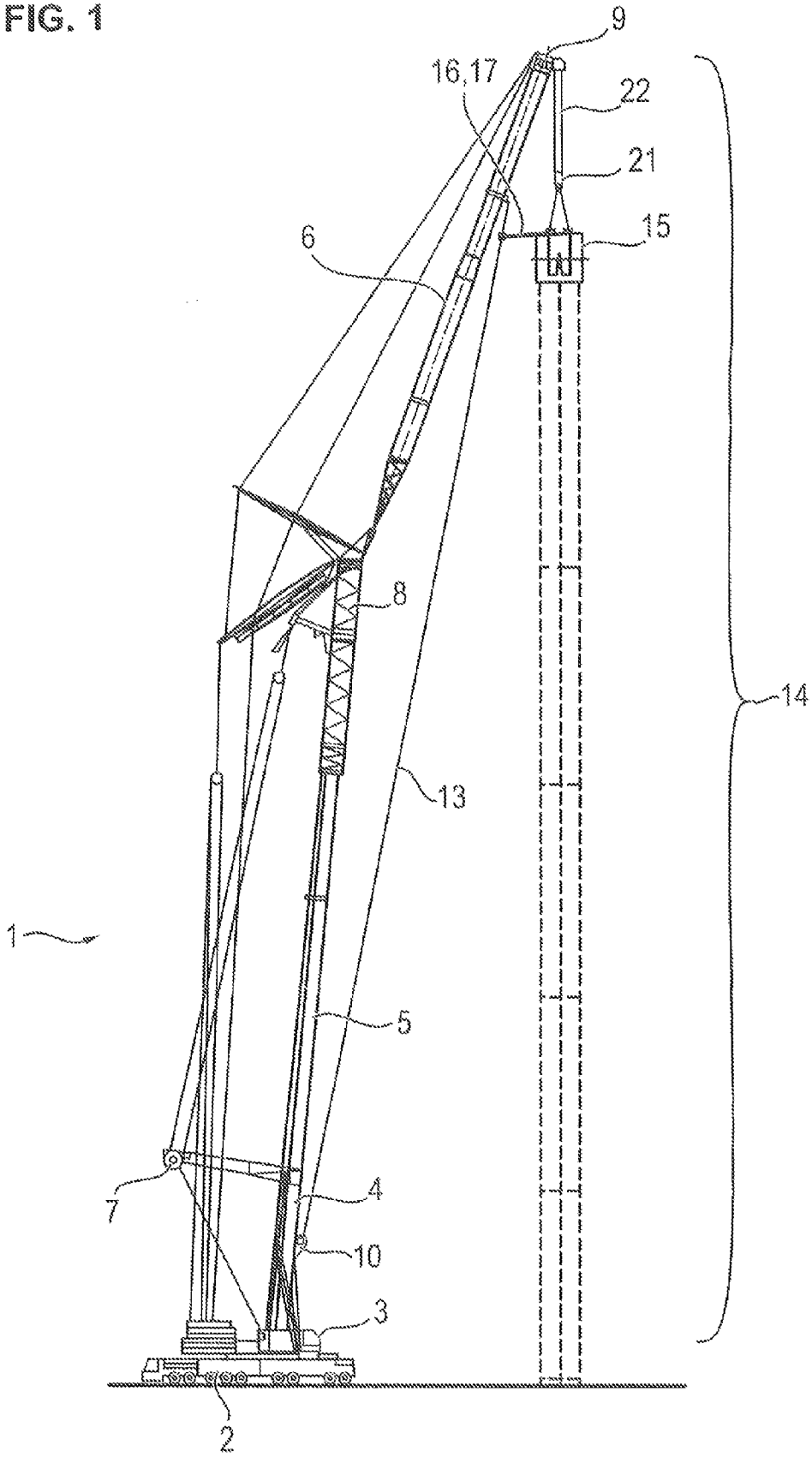
FIG. 1: shows a side view of a truck crane with telescopic boom in aligned position.

In a manner known per se, the truck crane 1 shown in FIG. 1 has an undercarriage 2 formed as truck on which an uppercarriage 3 rotatable about an upright axis is mounted. The uppercarriage 3 carries a boom system 14 luffable about a lying axis, which includes a joint section 4 articulated to the uppercarriage 3 and a plurality of telescopic sections to be telescoped out therefrom. At the innermost telescopic section of the main boom 5 a luffable lattice jib 6 is arranged, which can be connected via lattice pieces 8. The main boom 5 is guyed by means of a guying 7 which is formed as a spatial Y-guy known per se.

A hoisting cable 22 is guided over the luffing jib 6 via a deflection pulley 9 and carries a load hook 21. On the load hook 21 a frame 15 is suspended, which serves for taking up a non-illustrated rotor blade of a wind turbine.

For stabilizing the frame 15, in particular while mounting the rotor blade on the wind rotor hub, only one single winch 10 now is provided, which is located almost on the line of symmetry of the boom system 14. The same is directly mounted on the joint section 4 of the main boom 5 and is coupled to the central crane system by the energy supply provided and by the control connection. The control of the winch 10 for example is effected proceeding from the crane controller via the bus system.

Alternatively (not shown in FIG. 1), the winch 10 also can be mounted in the region of the boom foot, i.e. on the uppercarriage.

Proceeding from the winch 10, the guide cable 13 extends to the outer region of the boom system 14. Depending on its use, the outer end of the cable 13 can flexibly be attached at any point of the boom system 14. In the illustrated exemplary embodiment of FIG. 1, the guide cable 13 is firmly arranged on the luffing jib 6 close to the region of the deflection pulley 9.

Depending on the crane movement made, such as a luffing of the luffing jib 6 or a telescoping out of the main boom 5 of the boom system 14, the winch 10 is actuated synchronously by the controller. Furthermore, a maximum winding force is defined for the winch 10. If the admissible winding force of the winch is exceeded, the winch automatically lets out some cable.

Figure 2:
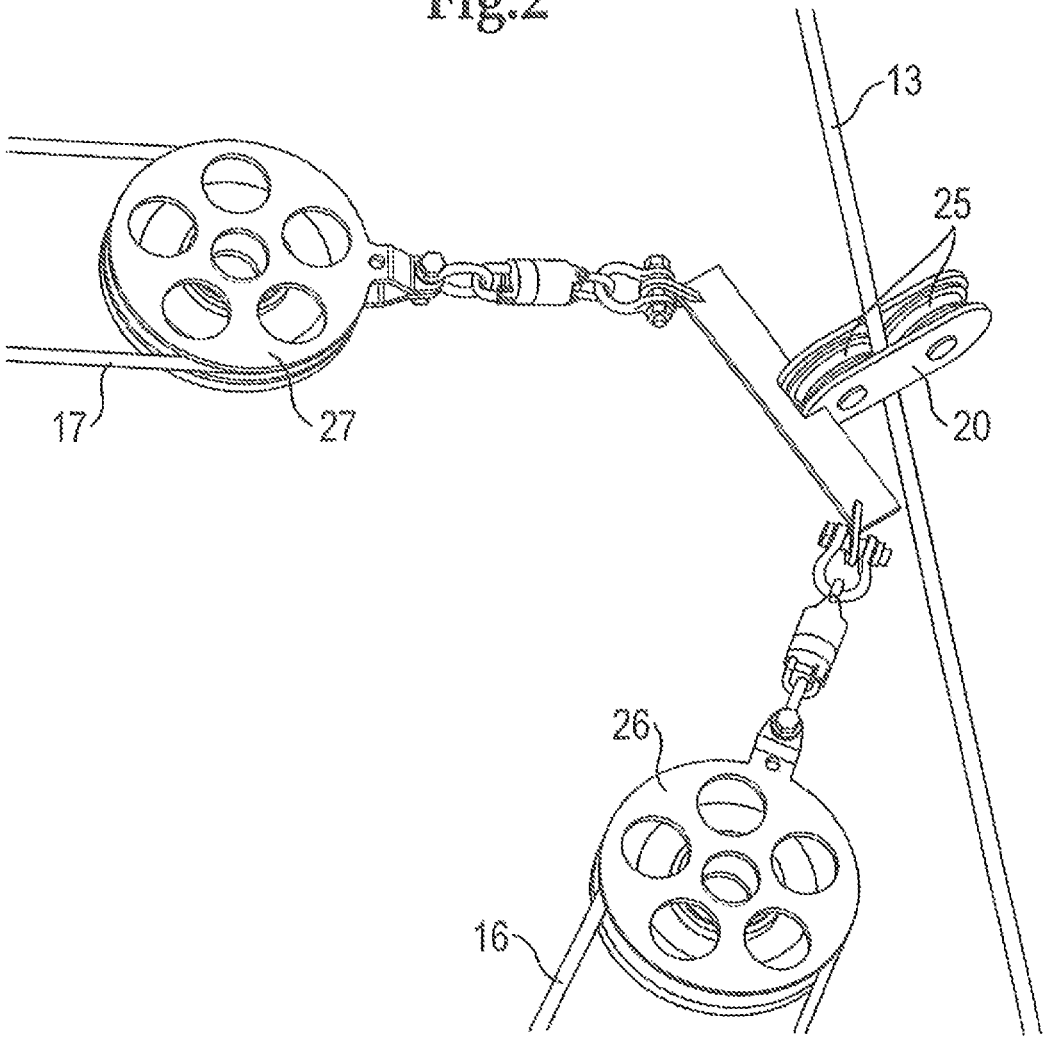
FIG. 2: shows a detailed view of a point of connection between the guide cable and the control cables.

Proceeding from the frame 15, the two control cables 16, 17 extend in direction of the guide cable 13. For connecting the control cables 16, 17 with the guide cable 13, the connecting link 20 is used, which can be taken from the detailed representation in FIG. 2. The connecting link 20 includes a dual pulley 25 which is guided along the guide cable 13. Symmetrical to the dual pulley 25, the two deflection pulleys 26, 27 are movably attached to the connecting link. The control cables 16, 17 are deflected by the deflection pulleys 26, 27 and are guided back to the frame 15.

On the frame itself, the control cables 16, 17 are deflected by further deflection pulleys and controlled by a corresponding winch drive. Via the winch drive on the frame 15, the control cables 16, 17 can be actuated correspondingly, in order to stabilize or readjust the horizontal position of the frame 15 at the hoisting height. The use of the individual deflection pulleys provides for a reduction of force in the cable and in the cable drive of the frame 15.

At this point, it should again be mentioned expressly that the invention is not limited to the receptacle of a rotor blade. Via the frame 15, any load fitting into the receptacle of the frame 15 can be taken up.

By using an individual guide cable, the influence of the control cables 16, 17 on the boom system 14 is reduced considerably as compared to known solutions from the prior art. Furthermore, the symmetrical arrangement of the winch 10 as well as the course of the guide cable 13 along the plane of symmetry of the boom system 14 involves the decisive advantage that the side load on the boom system 14 is reduced as far as possible. The designs known so far, which rely on a plurality of guide cables and on the use of the existing guying, have the disadvantage that the guide cables extend outside the plane of symmetry laterally beside the boom system 14. With an unequal action of force of the control cables on the corresponding guide cables, this results in a considerable side load of the boom system 14.

The invention claimed is:

1. A crane for taking up a load, wherein a single guide cable (13) is arranged without guying function and, proceeding from a boom foot, is tensioned parallel to a direction of a longitudinal axis of a boom system (14) and is attached to the boom system (14) at an end thereof, a frame (15) is suspended on a load hook (21) in turn suspended (22) from the boom system (14), at least two separate, independent control cables (16, 17) are each connected to the frame (15) independently from one another, and both separate, independent control cables (16, 17) are connected with the single guide cable (13) at the same location on the single guide cable (13), to thereby connect the frame (15) with the single guide cable (13).

2. The crane according to claim 1, wherein the guide cable is attached to the boom system at its end at variable height.

3. The crane according to claim 1, wherein the control cables are at least partly guided along the guide cable.

4. The crane according to claim 1, additionally comprising only a single winch arranged for tensioning the guide cable and which is arranged near the boom foot.

5. The crane according to claim 4, wherein the sole winch is arranged near or on a line of symmetry of the boom system.

6. The crane according to claim 5, wherein the winch is directly or indirectly arranged on one of an articulation piece, an uppercarriage, and a luffing cylinder.

7. The crane according to claim 4, wherein the winch is directly or indirectly arranged on one of an articulation piece, an uppercarriage, and a luffing cylinder.

8. The crane according to claim 4, wherein the guide cable extends along a plane of symmetry of the boom system in a direction of a tip of a boom.

9. The crane according to claim 8, wherein the winch is directly or indirectly arranged on one of an articulation piece, an uppercarriage, and a luffing cylinder.

10. The crane according to claim 1, wherein one or more deflection pulleys are provided, which at least partly deflect the control cables in the point of connection with the guide cable.

11. The crane according to claim 1, wherein the control cables are guided along the guide cable by a connecting link.

12. The crane according to claim 1 which is a telescopic crane comprising a telescopic main boom (5), a jib (6) pivotally mounted on a tip of the telescopic main boom (5), an uppercarriage (3) on which the telescopic main boom (5) is pivotally mounted at an end opposite the jib (6), and guying (7) for the telescopic main boom (5).

13. The crane according to claim 12, wherein an end of the guide cable (13) is attached to the jib (6).

14. The crane according to claim 1, arranged for hoisting a rotor blade of a wind turbine.

15. The crane according to claim 1, additionally comprising a link (20) for connecting the control cables (16, 17) with the single guide cable (13) and comprising a dual pulley (25) guided along the guide cable (13) and a pair of deflection pulleys (26, 27) each coupled to the dual pulley (25), and with each control cable (16, 17) wound about a respective deflection pulley (26, 27).

* * * * *